US009669448B2

(12) United States Patent
Marti

(10) Patent No.: US 9,669,448 B2
(45) Date of Patent: Jun. 6, 2017

(54) TOOL AND METHOD FOR PRODUCING STAMPED PARTS

(71) Applicant: Feintool International Holding AG, Lyss (CH)

(72) Inventor: Andreas Marti, Jegenstorf (CH)

(73) Assignee: Feintool International Holding AG, Lyss (CH)

( * ) Notice: Subject to any disclaimer, the term of this patent is extended or adjusted under 35 U.S.C. 154(b) by 280 days.

(21) Appl. No.: 14/467,483

(22) Filed: Aug. 25, 2014

(65) Prior Publication Data

US 2015/0101385 A1 Apr. 16, 2015

(30) Foreign Application Priority Data

Aug. 28, 2013 (EP) ..... 13004190

(51) Int. Cl.

| | |
|---|---|
| ***B21D 28/16*** | (2006.01) |
| ***B21D 19/00*** | (2006.01) |
| ***B21D 13/02*** | (2006.01) |
| ***B21D 22/02*** | (2006.01) |
| ***B21D 28/02*** | (2006.01) |
| ***B21D 35/00*** | (2006.01) |
| ***B21D 53/28*** | (2006.01) |

(52) U.S. Cl.

CPC ..... *B21D 28/16* (2013.01); *B21D 13/02* (2013.01); *B21D 19/005* (2013.01); *B21D 22/02* (2013.01); *B21D 28/02* (2013.01); *B21D 35/001* (2013.01); *B21D 53/28* (2013.01)

(58) Field of Classification Search

CPC ..... B21D 22/02; B21D 28/02; B21D 28/16; B21D 19/005; B21D 28/26; B21D 19/00; B21D 31/02; B21D 35/00; B21D 35/001; B21D 28/14; B21D 22/00; B21D 53/28; B21D 45/06

USPC ..... 72/336, 337, 332, 333

See application file for complete search history.

(56) References Cited

U.S. PATENT DOCUMENTS 5,794,484 A * 8/1998 Jaddou ..... B21D 13/02 29/896.9
6,212,930 B1 * 4/2001 Skrabs ..... B21D 19/005 72/336

(Continued)

FOREIGN PATENT DOCUMENTS

DE 196 08 551 9/1997
DE 10 2010 028 280 11/2011

*Primary Examiner* — Moshe Wilensky
*Assistant Examiner* — Mohammad Yusuf
(74) *Attorney, Agent, or Firm* — Norris McLaughlin & Marcus, P.A.

(57) ABSTRACT

An upper die part includes an embossing bell, a stripper ring, and an inner shape embossing element. The stripper ring has an embossing surface with a corrugated profile on the embossing surface. A lower die part includes an embossing anvil having a corrugated profile on its embossing surface. The embossing bell and the inner shape embossing element each are provided with an embossing shoulder, which are disposed, with respect to the corrugated profile of the stripper ring, in the stroke direction in such a way that the shoulders can seize the burrs only alter the corrugating step. The corrugating step takes place prior to burr compression. The outer and inner contours of the disk are not able to change positions, but are able to change shapes on the burr side after the corrugating step.

13 Claims, 16 Drawing Sheets

(56) References Cited

U.S. PATENT DOCUMENTS

| | | | | |
|---|---|---|---|---|
| 9,533,340 | B2 * | 1/2017 | Morlo | B21D 28/16 |
| 2005/0061407 | A1 * | 3/2005 | Ono | B21D 13/02<br>148/645 |
| 2011/0265541 | A1 * | 11/2011 | Morlo | B21D 35/00<br>72/339 |

* cited by examiner

Detail X

TOOL AND METHOD FOR PRODUCING STAMPED PARTS

BACKGROUND OF THE INVENTION

The invention relates to a method and tool for producing stamped disks, including at least one stamping or fine blanking stage and at least one corrugating and embossing stage.

A method and a device for producing corrugated disks in two method steps is known from DE 10 2010 028 280 A1, wherein a workpiece is stamped or fine blanked in a first method step, transported between the first method step and a second method step, and corrugated and simultaneously deburred in the second method step. The method is carried out using a two-stage tool, the first stage of which is designed as a fine blanking stage and the second stage of which is designed as an embossing and corrugating stage.

Rollover typically develops during fine blanking, which in particular increases as the corner radius decreases and the sheet metal thickness increases. The rollover depth can be approximately 20%, and the rollover width can be approximately 30% of the sheet metal thickness or more (see DIN 3345, Fine blanking, August 1980), such that the lack of sharp edges on the outer teeth of the disks can result in limitation of the component function.

Moreover, forming of the thin and planar disk blank in the corrugating stage results in warpage, which impairs the shape accuracy of the outer and inner contours, and more significantly the shape and dimensional accuracy of the outer teeth of the disk. As a result, the installation and functional properties are adversely affected. Complex reworking is then required.

A method for producing stamped parts, in particular planar disks, is described in DE 196 08 551 A1 in which, in a first method step, the workpiece is stamped from the raw material inside a device. After stamping, the workpiece is moved to an embossing stage by way of transfer tongs, which are likewise accommodated in the device. The burr on the disk is compressed in the embossing stage. This prior art has the disadvantage that the disk on which the burr has been compressed must be corrugated in an additional processing stage—as described in EP 1 128 081 B1, for example—which considerably increases the complexity and costs in production.

SUMMARY OF THE INVENTION

The invention relates to a method and tool for producing stamped parts, in particular disks. An upper part and a lower part form at least one stamping or fine blanking stage for cutting the inner and outer contours of a disk blank, and at least one corrugating and embossing stage for corrugating the disk blank and for embossing burrs on the disk blank that developed during cutting. The corrugating and embossing stage is divided into a lower die part and an upper die part.

The invention further relates to a method for producing stamped disks, in which the outer and inner contours of a disk blank are cut in a first method step from a flat strip inside a tool. The tool includes the upper part and lower part in the stamping or fine blanking stage. The fine-blanked disk blank is moved, after the tool has been opened, by a cross slide into a corrugating and embossing stage. The disk blank is provided with a corrugated profile in a second method step by forming on an upper die part and a lower die part after the tool has been closed. The burrs on the disk that developed during fine blanking are compressed. The first method step and the second method step are carried out in one stroke.

An object of the invention is to provide a tool and a method for producing corrugated disks, by way of which it becomes possible to increase the shape and dimensional accuracy and the sharp edges of the outer teeth of the corrugated disks, while reducing costs.

According to the invention, by not carrying out the corrugating step simultaneously with the compression of the burr, but rather chronologically prior thereto, it is possible to fix, and not influence, the outer and inner contours of the disk during the corrugating step. This ensures accuracy of the shape and dimensions.

The invention includes an upper die part, which comprises an embossing bell, a stripper ring that is provided with an embossing surface and has a corrugated profile on the embossing surface, and an inner shape embossing element. In addition, a lower die part comprises an embossing anvil having a corrugated profile on the embossing surface thereof. The embossing bell and the inner shape embossing element are each provided with an embossing shoulder, which are disposed with respect to the corrugated profile of the stripper ring in the stroke direction (H) in such a way that the shoulders can seize the burrs after the corrugating step. As a result, the corrugating step takes place prior to the burr compression step, and the outer and inner contours of the disk are not able to change position, but are able to change shape on the burr side after the corrugating step.

It is particularly advantageous that the embossing bell for fixing the outer contour of the disk blank has an annular design and completely surrounds the outer contour, and that the inner shape embossing element is disposed supported against the inner contour. The outer and inner contours are thus fixed as if they were clamped, so that the outer and inner contours of the disk blank cannot be influenced by the forming operation.

According to a preferred variant embodiment of the tool according to the invention, the stripper ring is vertically supported on the inner wall of the embossing bell and on the outer wall of the inner shape embossing element. As a result, the embossing surface of the stripper ring is securely guided in a defined position relative to the disk blank.

In a further embodiment of the tool according to the invention, the inner wall of the embossing bell has a profile, which is adapted to the profile, and more particularly to the teeth, of the outer contour of the disk blank. This allows vertical guidance of the stripper ring, while also radially securing the outer contour against rotation of the disk blank during the forming operation.

In a refinement of the invention, the outer wall of the inner shape embossing element is adapted to the inner contour of the disk blank, so that the disk blank is likewise secured against radial rotation.

In a further embodiment of the tool according to the invention, the embossing anvil in the lower die part has an annular design and is associated with the stripper ring in the upper die part. A filler piece for transmitting the force and for providing support is disposed in the interior space of the embossing anvil.

It is of essential importance for the invention that the embossing shoulder is disposed on the inner wall of the embossing bell, and that the embossing shoulder of the inner shape embossing element is disposed on the outer wall of the same. The positions and shapes of the embossing shoulders are matched to the size and shape of the burr, the thickness of the disk blank, and the corrugated profiles of the embossing surfaces of the stripper ring and the embossing anvil.

This ensures that the corrugating step can take place prior to burr compression on the burr side of the disk blank.

The lower die part moreover comprises an intermediate ring, which is vertically guided in a cavity frame and is adapted to the embossing bell. The ring surface of the bell forms a seat for the embossing bell when the upper die part and the lower die part are closed. The inner will is adapted to the fine-blanked outer contour of the disk blank. The disk blank is thus exactly situated in a defined position between the embossing surfaces of the stripper ring and the embossing anvil. Accordingly, the outer and inner contours are fixed by the embossing bell and the inner shape embossing element. The stripper ring, embossing anvil, embossing bell and the inner shape embossing element effectively form the die in which the forming operations are carried out.

According to a further embodiment of the tool according to the invention, the embossing bell is operatively connected via an upper pressure plate, and the inner shape embossing element is operatively connected via a further pressure plate, to a fixed upper block of the upper part for carrying out all operations. The upper block can, of course, also be designed so as to perform stroke movements. In such a case, the lower block is designed in a corresponding stationary manner.

The stripper ring, which in a further advantageous embodiment of the invention also performs a forming function, is operatively connected via a pressure pin and an upper ring plate to an additional hydraulic unit for stripping off the completely formed disk.

The cavity frame, in which the intermediate ring and the embossing anvil are vertically guided by way of a lower pressure plate and operatively connected to a lower additional hydraulic unit, is fixed in a stationary manner on the lower block. The lower block is connected to the press ram, so that the lower part of the tool is able to carry out a stroke movement for fixing, corrugating and compressing the disk blank.

In a further embodiment of the tool according to the invention, the embossing surfaces of the embossing anvil and of the stripper ring can have different embossing profiles that are matched to each other. For example a corrugated profile has uniformly shaped corrugation peaks and corrugation troughs. Or, an irregular corrugated profile comprising at least two corrugations has differently shaped and spaced corrugation peaks and corrugation troughs. As a result, disks having differing corrugations can be produced.

The object is further achieved by a method, according to which, in the corrugating and embossing stage, simultaneously with the disk blank corrugating step, the outer and inner contours are fixed so as to maintain the positions and shapes thereof during corrugating. The corrugating takes place prior to burr compression. The outer and inner contours of the disk are not able to change positions, but are able to change shapes on the burr side, due to the subsequent compression.

It is particularly advantageous that the top and bottom sides of the disk blank are corrugated by an embossing anvil that is associated with the lower die part and by a stripper ring that is associated with the upper die part. The stripper ring thus performs both a forming function and a stripping function for the corrugated disk.

In a further embodiment of the method according to the invention, different embossing profiles can be used as the embossing surfaces for the anvil and the stripper ring. For example a corrugated profile has uniformly shaped corrugation peaks and corrugation troughs. Or, an irregular corrugated profile comprising at least two corrugations has differently shaped and spaced corrugation peaks and corrugation troughs. Thus, the method according to the invention can be variably adapted to the different corrugation shapes and disk dimensions.

Further advantages, features and details of the invention will be apparent from the following description with reference to the accompanying drawings.

DETAILED DESCRIPTION OF SPECIFIC EMBODIMENTS

The invention shall be described in more detail hereafter based on the example of producing a disk having outer teeth. It is intended that the invention also encompass disks having inner teeth.

Figure 1A:
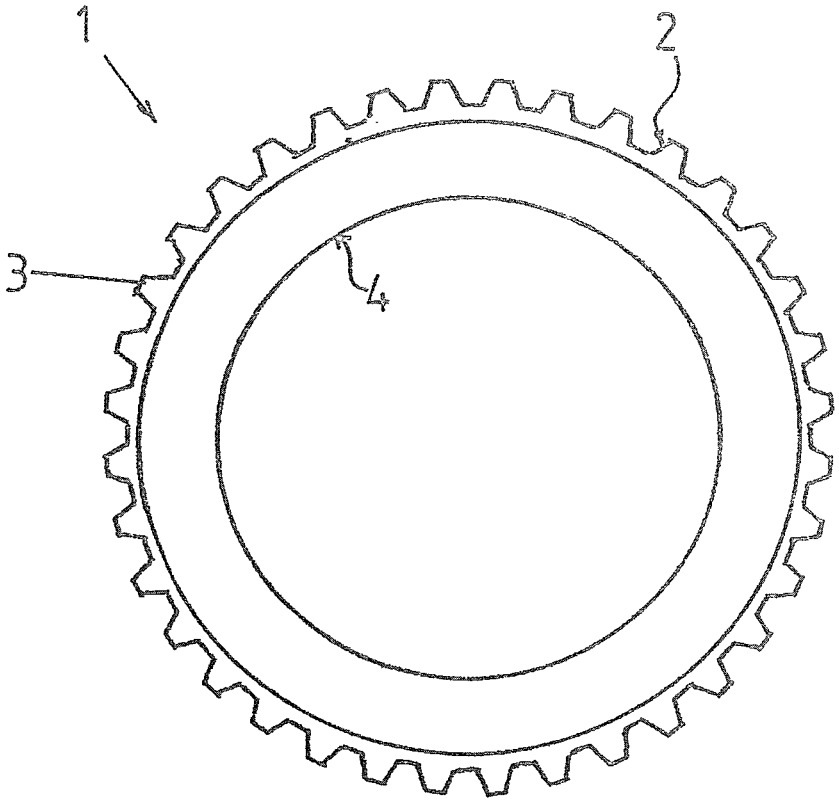
FIGS. 1*a* and 1*b* show a perspective view and a side view of a commercially available corrugated outer disk.
Figure 1B:
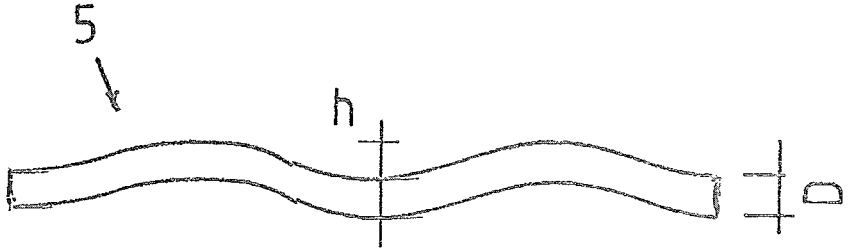

FIGS. 1*a* and 1*b* show a commercially available corrugated outer disk 1, which has an outer contour 2 having teeth 3 and a circular inner contour 4, wherein the outer disk 1 is provided with a corrugation 5 (see FIG. 1*b*). For example, the outer disk 1 has a thickness D of 1.8 mm and is made of steel.

Figure 2:
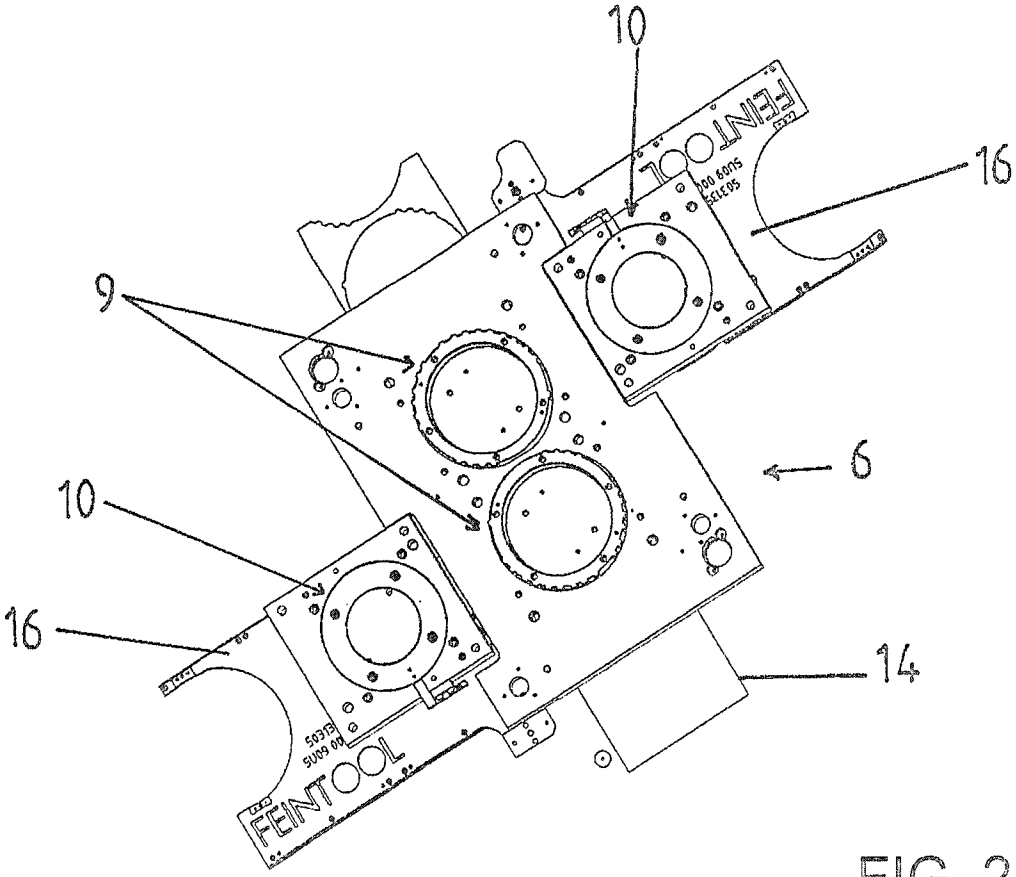
FIG. 2 shows a perspective top view onto an exemplary arrangement of a fine blanking stage and a corrugating and embossing stage in a tool according to the invention.
Figure 3:
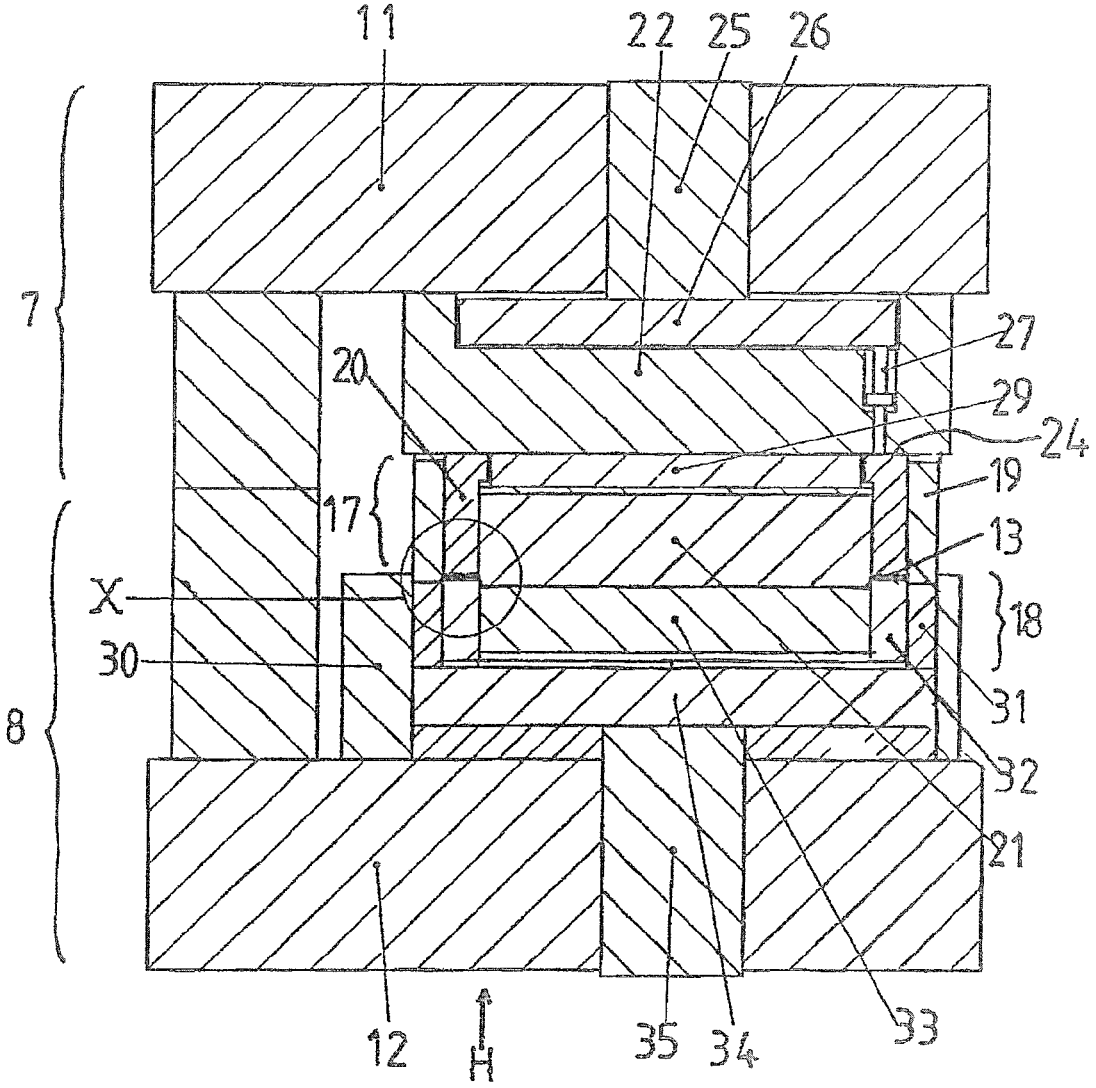
FIG. 3 shows a schematic sectional illustration of the tool according to the invention when the tool is closed.

The outer disk 1 is to be produced using a fine blanking tool 6, which comprises an upper part 7 and a lower part 8, which—as shown in FIGS. 2 and 3—form at least one fine blanking stage 9 and at least one corrugating and embossing stage 10.

The upper block 11 of the upper part 7 is fixed in a stationary manner on a machine table, which is not shown, and the lower block 12 of the lower part 8 is fixed on a ram of a press so as to be able to perform stroke movements. The disk blank 13 is fine-blanked from bottom to top—which is to say in the direction of the upper part—from a flat strip 14 in the fine blanking stage 9, which corresponds to the known prior art and therefore does not have be described in more detail.

Figure 14A:
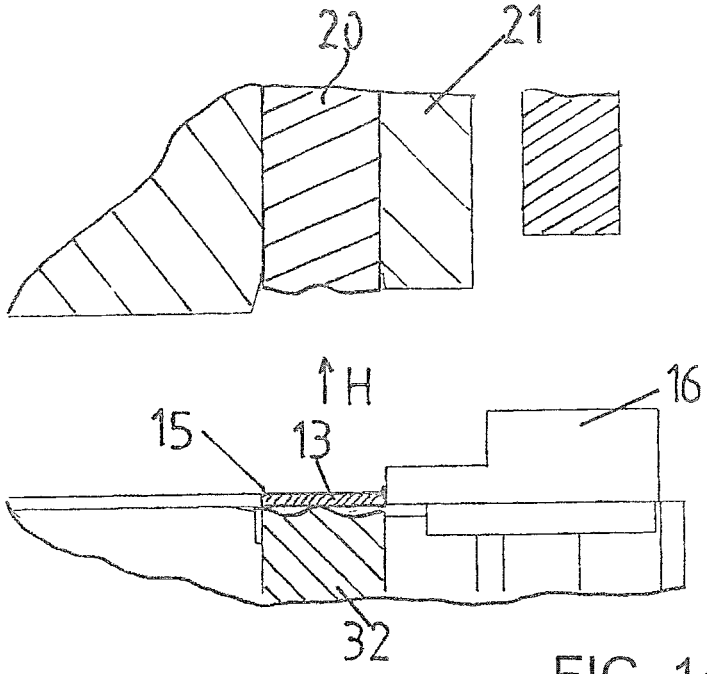
FIGS. 14*a* to 14*d* show a schematic illustration of the flow of the method according to the invention.
Figure 14B:
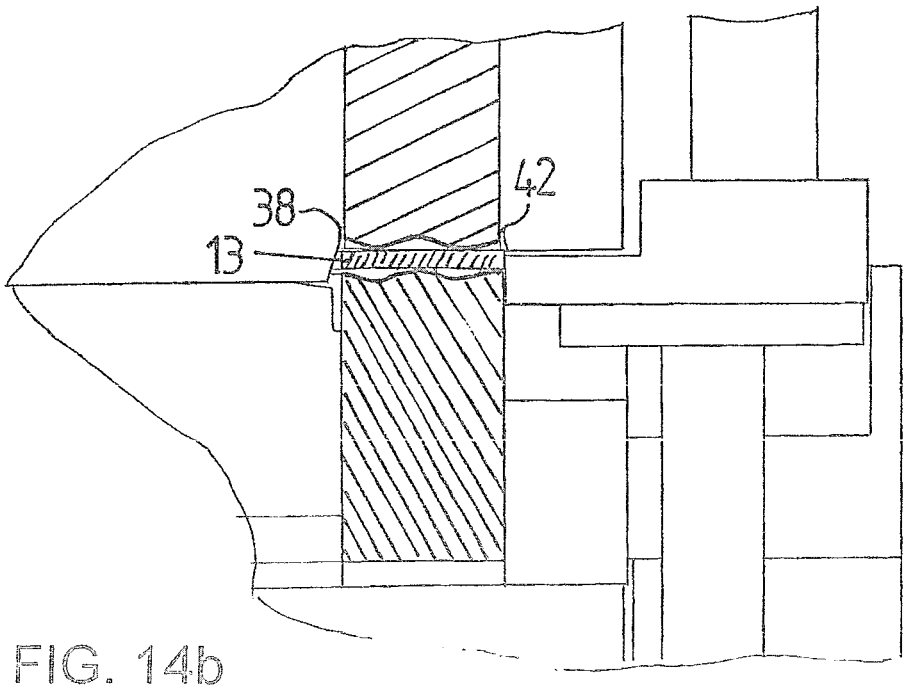
Figure 14C:
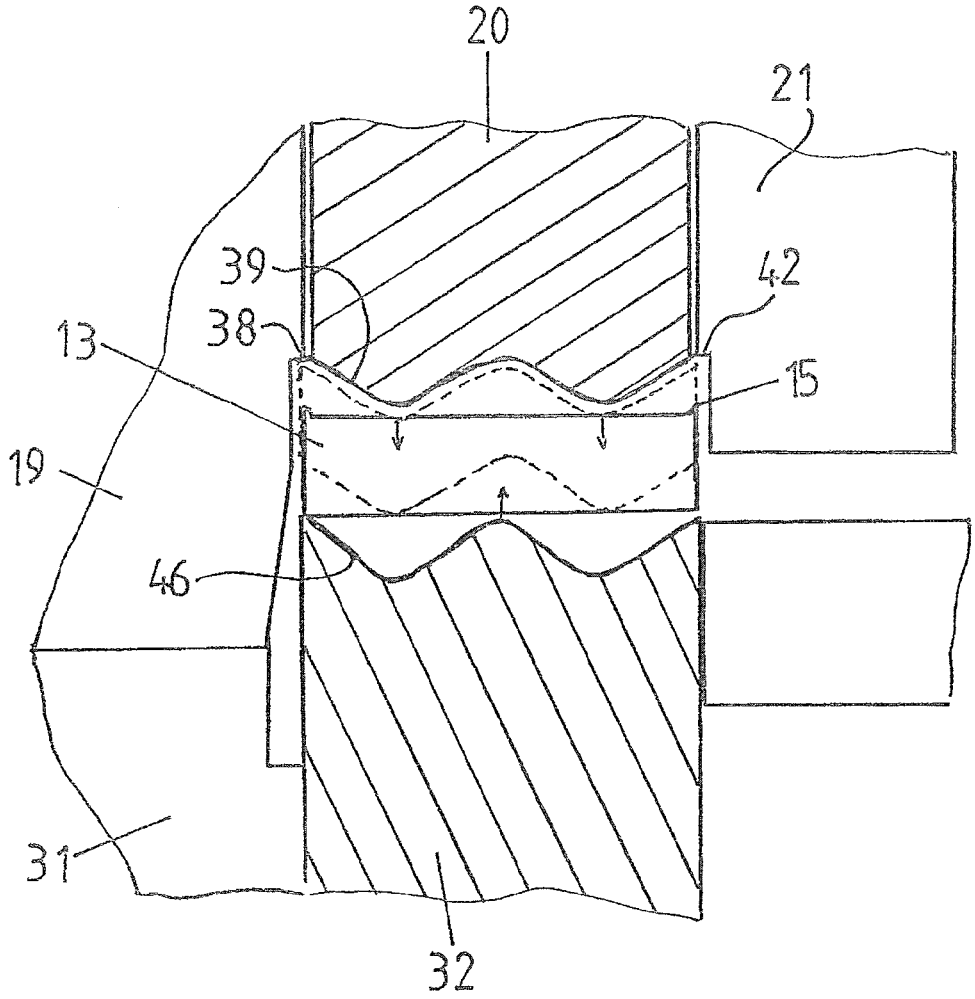

The burrs 15 on the disk blank 13 protrude vertically upward on the outer contour 2 and the inner contour 3 of the disk blank 13 (see also FIG. 14*c*). After having been ejected from the fine blanking stage 9, the fine-planked disk blank 13 is seized by a cross slide 16 and transported by the same into the corrugating and embossing stage 10, where the disk blank is deposited in an accurately positioned manner prior to the corrugating step.

FIG. 3 shows the basic design of the embossing and corrugating stage 10 when the same is closed. The embossing and corrugating stage 10 comprises an upper die part 17 and a lower die part 18. The upper die part 17 includes an annular embossing bell 19, an annular stripper ring 20, and an inner shape embossing element 21. The embossing bell 19 is fixed to an upper embossing pressure plate 22 in a stationary manner, the pressure plate in turn being fixed to the upper block 11.

The stripper ring 20 is supported vertically on the inner wall 23 of the embossing bell 19 and horizontally on the upper embossing pressure plate 22. The stripper ring 20, on the side 24 thereof facing the embossing pressure plate 22, is able to carry out a vertical relative movement with respect to the embossing bell 19 by way of a pressure pin 27, which can be actuated by an upper additional hydraulic unit 25 and a ring plate 26. The inner shape embossing element 21, which vertically guides and supports the stripper ring 20 on the outer wall 28, is inserted into the annular stripper ring 20. A separate pressure plate 29, which is operatively connected to the embossing pressure plate 22 for force transmission, and which is disposed in the annular stripper ring 20, is seated on the inner shape embossing element 21.

The lower die part 18 is formed by an annular cavity frame 30, an intermediate ring 31, an annular embossing anvil 32, and a filler piece 33. The cavity frame 30 is attached to the lower block 12. The intermediate ring 31, the embossing anvil 32 and the filler piece 33 are seated on a lower embossing pressure plate 34, which in turn is operatively connected via a lower additional hydraulic unit 35.

Figure 4:
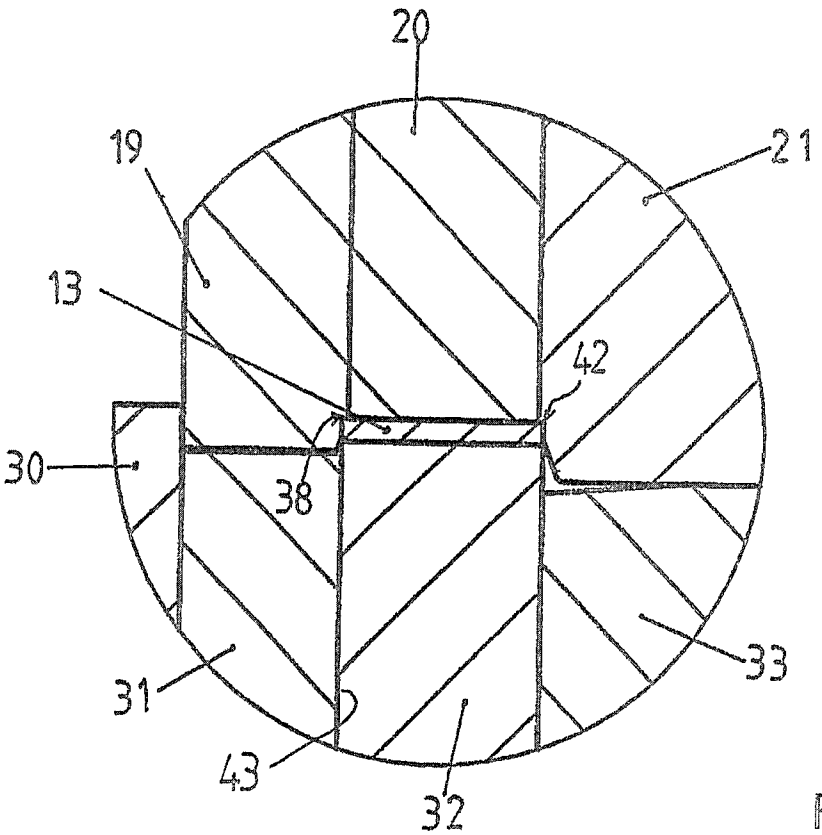
FIG. 4 shows an enlarged illustration of the disk blank between the embossing anvil, the stripper ring, the embossing bell and the inner shape embossing element as detail X from FIG. 3.
Figure 5:
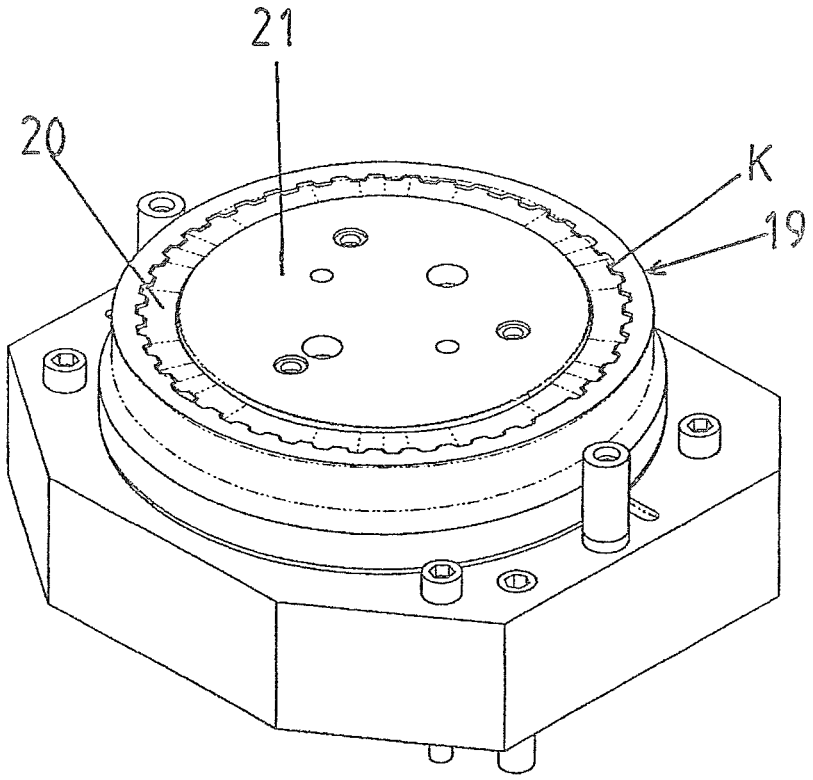
FIG. 5 shows a perspective view of the upper die part of the tool according to the invention.

As is shown in enlarged form in FIG. 4, the embossing bell 19, the stripper ring 20 and the inner shape embossing element 21 of the upper die part 17, together with the intermediate ring 31, the embossing anvil 32 and the filler piece 33 of the lower die part 18, in each case form operative pairs with respect to the disk blank 13.

The outer contour 2 of the disk blank 13 is surrounded by the embossing bell 19, and the inner contour 4 of the same is surrounded by the inner shape embossing element 21, so that no warpage can develop on the disk blank 13 during the corrugating step of the disk blank 13 between the stripper ring 20 and the embossing anvil 30.

FIGS. 5 to 10 illustrate the design of the upper die part 17. It is clearly apparent that the inner wall 23 of the embossing bell 19 and the outer wall 36*a* of the stripper ring 20 are matched to each other and together have contours K, which correspond to the outer contour 2 of the disk blank 13. The inner shape embossing element 21 is disposed in a vertically guided manner in the annular stripper ring 20.

Figure 6:
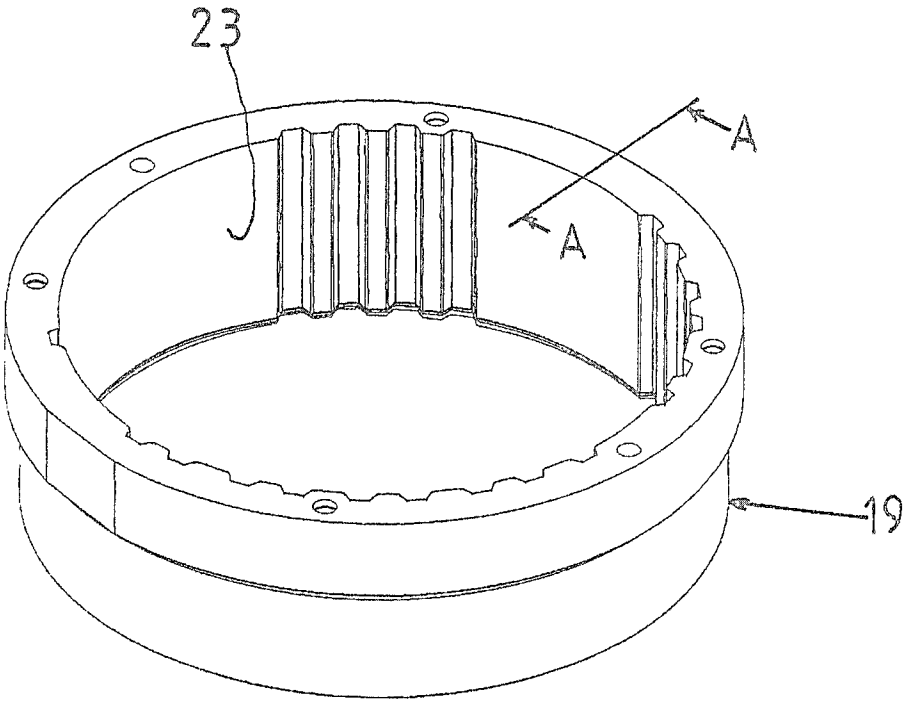
FIG. 6 shows a perspective view of the embossing bell of the tool according to the invention.
Figure 7:
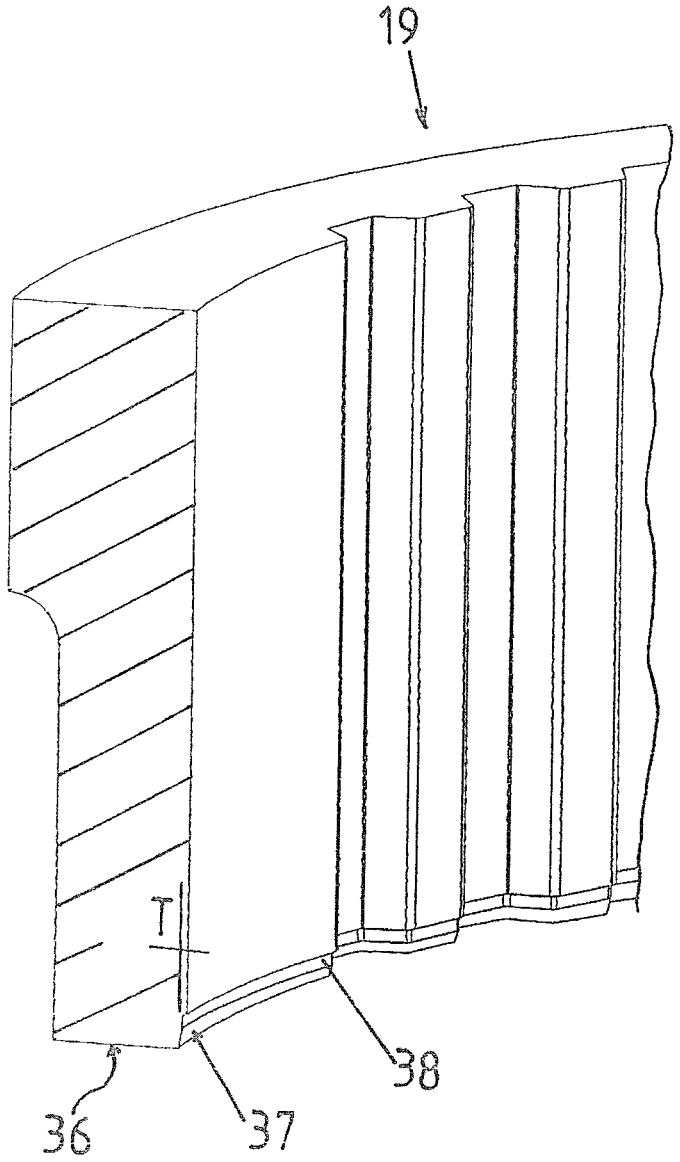
FIG. 7 shows a section along line A-A from FIG. 6.

FIGS. 6 and 7 show a perspective view of the embossing bell 19 and a section along line A-A from FIG. 6. On the centering edge 37 formed by the lower seat surface 36 and the inner wall 23, the embossing bell 19 comprises an embossing shoulder 38, the depth T of which is matched to the dimensions and shape of the upwardly protruding burr on the outer contour 2, the thickness D of the outer disk 1, and the height h of the corrugation peak of the corrugated profile.

Figure 8:
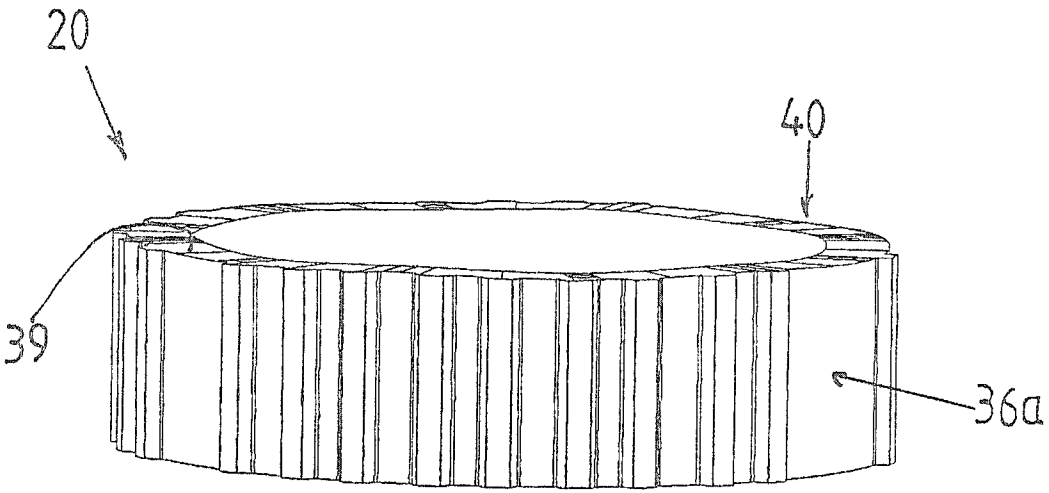
FIG. 8 shows a perspective view of the stripper ring.

FIG. 8 shows the stripper ring 2, which has a corrugated profile 39 on the embossing surface 40 thereof facing the embossing anvil 32. This corrugated profile 39 is matched to the desired corrugation of the outer disk 1.

Figure 9:
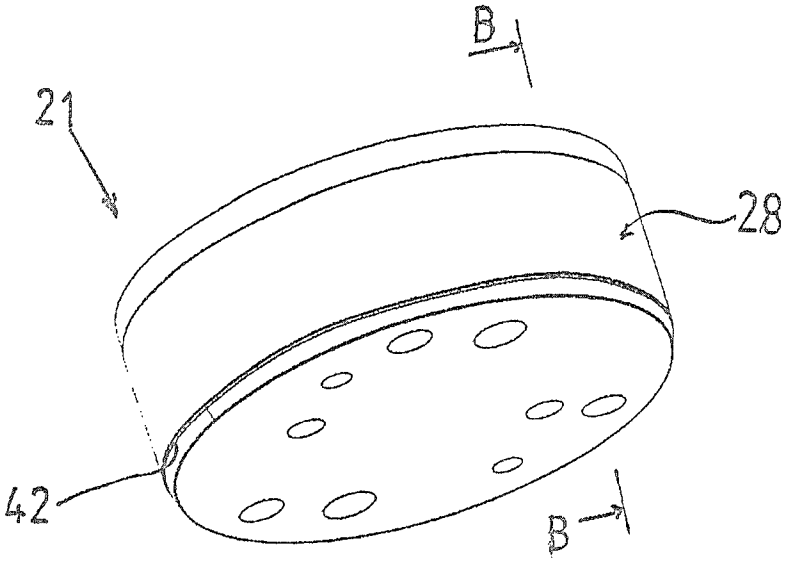
FIG. 9 shows a perspective view of the inner shape embossing element.
Figure 10:
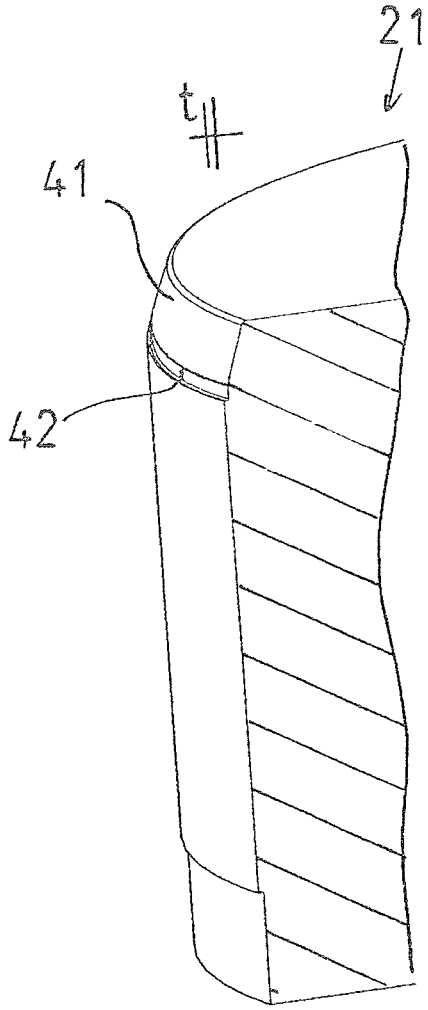
FIG. 10 shows a section along line B-B from FIG. 9.

The inner shape embossing element 21 has a cylindrical shape, and the contour thereof is matched to the inner contour 4 of the disk blank 13 (see FIG. 9). It is apparent from FIG. 10 that, on the lower centering edge 41 thereof facing the upwardly protruding burr 15 on the inner contour 4, the inner shape embossing element 21 has an embossing shoulder 42, the depth t of which is matched to the dimensions and shape of the burr 15, the thickness D of the outer disk 1, and the height h of the corrugated profile.

Figure 11:
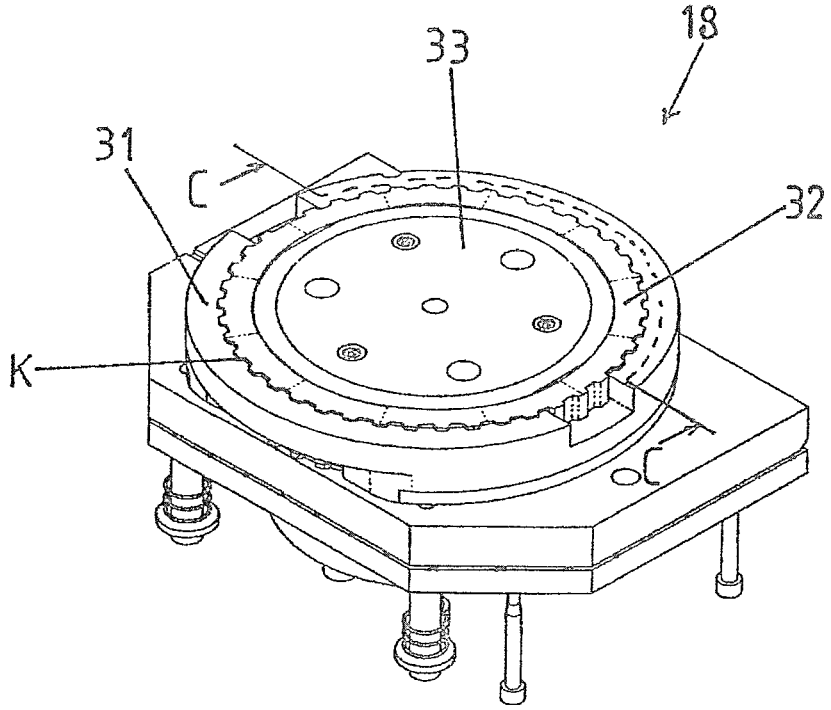
FIG. 11 shows a perspective view of the lower die part.

The lower die part 18 is shown in FIG. 11, without the cavity frame. The inner wall 43 of the intermediate ring 31 and the outer wall 44 of the embossing anvil 32 have contours K that are matched to each other and correspond to the outer contour 3 of the disk blank 13.

Figure 12:
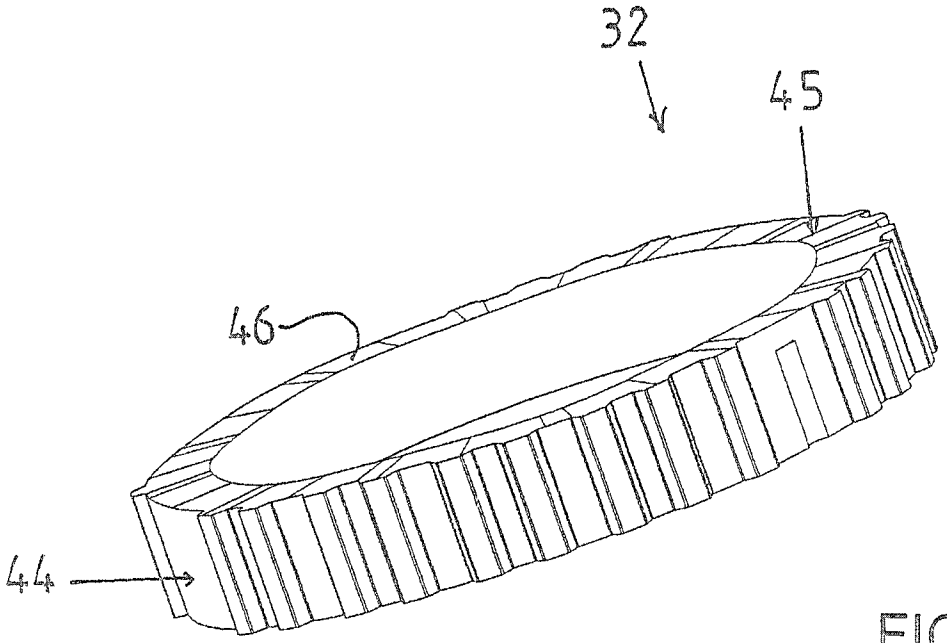
FIG. 12 shows a perspective view of the embossing anvil.
Figure 13A:
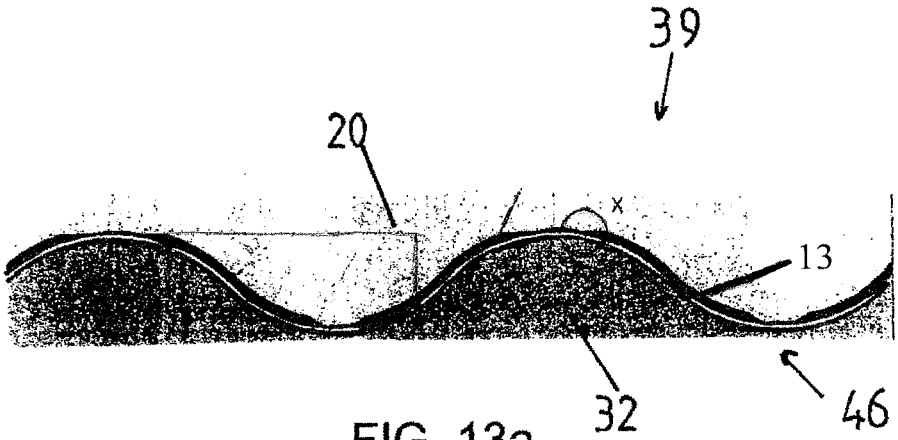
FIGS. 13*a* to 13*c* show variants of corrugated profiles in a development illustration according to the section along line C-C from FIG. 11.
Figure 13B:
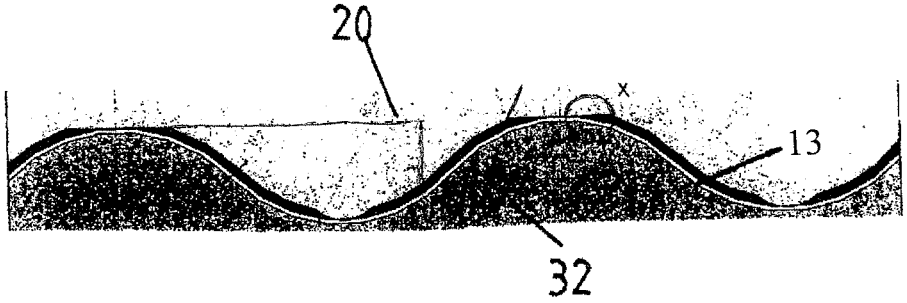
Figure 13C:
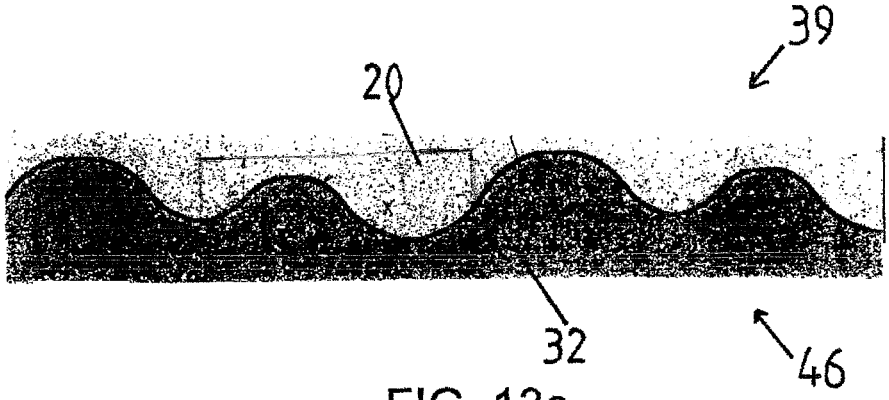

As is shown in FIG. 12, the embossing surface 45 of the embossing anvil 32 has a corrugated profile 46, which is adapted to the desired corrugation of the outer disk 1. Examples of corrugated profiles 39 and 46 on the stripper ring 20 and the embossing anvil 32, respectively, are shown in development views in FIGS. 13*a* to 13*c* according to the section line C-C in FIG. 11. In this way, depending on the requirements, corrugations that are distributed uniformly or non-uniformly on the circumference of the disk blank 13 can be provided, such as triple corrugations, quadruple corrugations or 2+2 corrugations.

The method according to the invention will be described based on FIGS. 14*a* to 14*d*. In FIG. 14*a*, the cross slide 16 has deposited the disk blank 13 on the embossing anvil 32. Centering according the outer contour 2 of the disk blank 13 is carried out by the centering edge 37 of the embossing bell 19, and centering according to the inner contour 4 is carried out by the centering edge 41, so that the disk blank 13 becomes seated in an accurate position on the embossing anvil 19 for the clamped state (see FIG. 14*b*).

FIG. 14*c* shows the state in which the corrugation peaks 47 of the corrugated profile 39 of the embossing surface 40 of the stripper ring 20 have reached the disk blank 13 due to the stroke movement of the embossing anvil 32. The corrugation forming process on the disk blank starts and is completed before the embossing shoulders 38 and 42 of the embossing bell 19 and the inner shape forming element 21, respectively, are able to seize the burr 15 on the outer contour 2 and the inner contour 4.

After another stroke of the embossing anvil 32, the embossing shoulders 38 and 42 reach the burr 15 and compress the same on the disk body. The embossing process is completed.

Figure 14D:
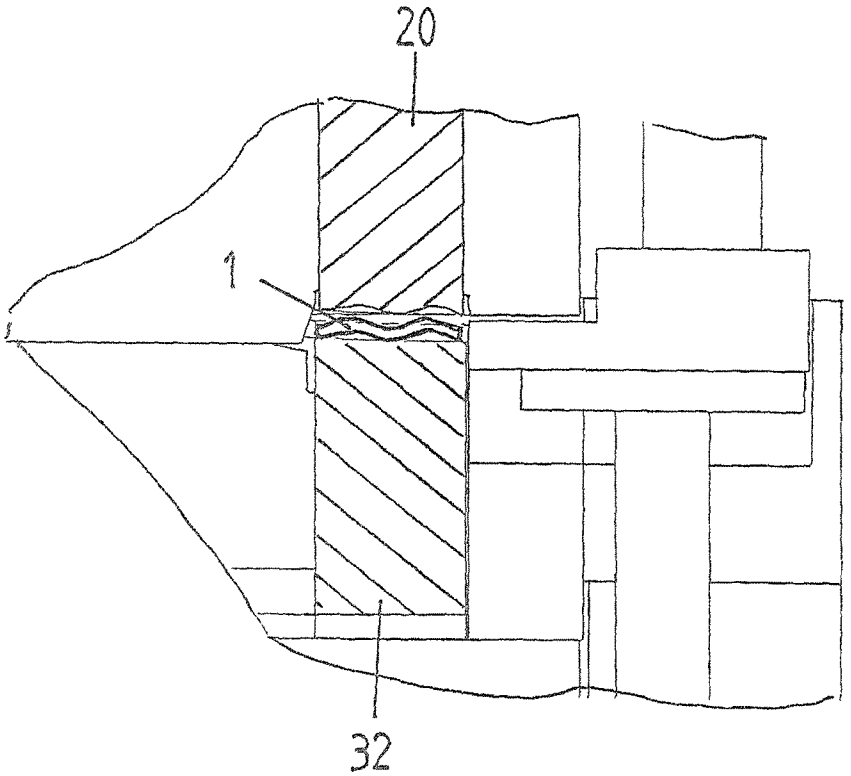

In FIG. 14*d*, the stripper ring 20 has stripped the outer disk 1, which is corrugated and on which the burr has been compressed, off of the embossing shoulders 38 and 42 by way of the upper additional hydraulic unit 25. After the tool is opened, the outer disk 1 can be transported on the toot by way of the cross slide 16.

The invention claimed is:

1. A tool for producing stamped disks, comprising:

an upper part and a lower part, which form at least one stamping or fine blanking stage for cutting the outer contour and inner contour of a disk blank and at least one corrugating and embossing stage for corrugating the disk blank and for compressing the burrs that developed during cutting, the corrugating and embossing stage being divided into an upper die part and a lower die part, wherein the upper die part comprise:

an embossing bell, a stripper ring, which is provided with an embossing surface and has a corrugated profile on the embossing surface, and an inner shape embossing element, and wherein the lower die part comprises:

an embossing anvil having a corrugated profile on the embossing surface thereof, wherein the embossing bell and the inner shape embossing element are each provided with an embossing shoulder which, are disposed, with respect to the corrugated profile of the stripper ring, in the stroke direction, wherein the shoulders are configured to seize the burrs only after a corrugating; operation, and so that the corrugating operation takes place prior to compression of the burr, and the outer contour and inner contour of the disk are not able to change positions, but are able to change shapes on the burr side after said corrugating operation.

2. The tool according to claim 1, wherein the embossing bell for fixing the outer contour of the disk blank has an annular design and completely surrounds the outer contour of the disk blank, and the inner shape embossing element is disposed supported against the inner contour.

3. The tool according to claim 1, wherein the stripper ring is vertically supported and guided on an inner wall of the embossing bell and on an outer wall of the inner shape embossing element.

4. The tool according to claim 2, wherein an inner wall of the embossing bell has a profile, which is adapted to the outer contour of the disk blank.

5. The tool according to claim 2, wherein an outer wall of the inner shape embossing element is adapted to the inner contour of the disk blank.

6. The tool according to claim 1, wherein the embossing shoulder is disposed on an inner wall of the embossing bell, and the embossing shoulder of the inner shape embossing element is disposed on an outer wall of same, wherein positions and shapes of the embossing shoulders are matched to dimensions and shape of the burr, a thickness of the disk blank, and the corrugated profile of the embossing surface of the stripper ring.

7. The tool according to claim 1, wherein the lower die part comprises an intermediate ring, which is vertically guided in a cavity frame and is adapted to the embossing bell, a ring surface of which forms a seat for the embossing bell when the upper die part and the lower die part are closed, and an inner wall of which is adapted to the fine-blanked outer contour of the disk blank.

8. The tool according to claim 1, wherein the embossing bell is operatively connected to an upper block via an upper embossing pressure plate, and the inner shape embossing element is operatively connected via a further pressure plate.

9. The tool according to claim 2, wherein the inner shape embossing element is disposed in a vertically guided manner in the stripper ring.

10. The tool according to claim 9, wherein the stripper ring is operatively connected via a pressure pin and an upper ring plate to an upper additional hydraulic unit for stripping off the disk.

11. The tool according to claim 1, wherein the lower die part further comprises a filler piece, which is vertically guided in the embossing anvil and is associated with the inner shape embossing element in the upper die part.

12. The tool according to claim 7, wherein the cavity frame is fixed on the lower block in a stationary manner.

13. The tool according to claim 7, wherein the intermediate ring and the embossing anvil are operatively connected to a lower additional hydraulic unit via a lower pressure plate and a lower block.

* * * * *